US011217159B2

(12) United States Patent
Zhang et al.

(10) Patent No.: US 11,217,159 B2
(45) Date of Patent: Jan. 4, 2022

(54) PIXEL CIRCUIT, DRIVING METHOD THEREOF, ELECTROLUMINESCENT PANEL AND DISPLAY DEVICE

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventors: Miao Zhang, Beijing (CN); Mo Chen, Beijing (CN); Jing Sun, Beijing (CN); Wuxia Fu, Beijing (CN)

(73) Assignees: BOE TECHNOLOGY GROUP CO., LTD., Beijing (CN); HEFEI XINSHENG OPTOELECTRONICS TECHNOLOGY CO., LTD., Anhui (CN)

( * ) Notice: Subject to any disclaimer, the term of this patent is extended or adjusted under 35 U.S.C. 154(b) by 871 days.

(21) Appl. No.: 15/778,404

(22) PCT Filed: Dec. 7, 2017

(86) PCT No.: PCT/CN2017/115082
§ 371 (c)(1),
(2) Date: May 23, 2018

(87) PCT Pub. No.: WO2018/133574
PCT Pub. Date: Jul. 26, 2018

(65) Prior Publication Data

US 2021/0210012 A1 Jul. 8, 2021

(30) Foreign Application Priority Data

Jan. 20, 2017 (CN) ..... 201710046234.3

(51) Int. Cl.
*G09G 3/3233* (2016.01)

(52) U.S. Cl.
CPC ... *G09G 3/3233* (2013.01); *G09G 2310/0262* (2013.01); *G09G 2320/0233* (2013.01)

(58) Field of Classification Search
CPC ..... G09G 3/3233; G09G 2310/0262; G09G 2320/0233
See application file for complete search history.

(56) References Cited

U.S. PATENT DOCUMENTS 8,130,173 B2 * 3/2012 Deane ..... G09G 3/3233 345/76
2005/0174311 A1 * 8/2005 Huh ..... G09G 3/3233 345/87

(Continued)

FOREIGN PATENT DOCUMENTS

CN 1742308 A 3/2006
CN 101937647 A 1/2011

(Continued)

OTHER PUBLICATIONS

International Search Report dated Mar. 5, 2018, issued in counterpart International Application No. PCT/CN2017/115082 (9 pages).

(Continued)

*Primary Examiner* — Jeff Piziali
(74) *Attorney, Agent, or Firm* — Westerman, Hattori, Daniels & Adrian, LLP

(57) ABSTRACT

A pixel circuit, a method thereof, an electroluminescent panel, and a display device are provided. The pixel circuit includes a first switch sub-circuit, a second switch sub-circuit, a luminescent sub-circuit, and a dual-drive sub-circuit. Through improving the pixel circuit, a first driving terminal of the dual-drive sub-circuit connects to a first node, a second driving terminal of the dual-drive sub-circuit connects to the second node, when a first and a second gate line signal terminal input the gate line scanning signal alternatively, the first and the second switch sub-circuit are (Continued)

working alternatively, cause the first and the second driving terminal are working alternatively, thus to drive the luminescent sub-circuit to emit light. Therefore, the two driving terminals work alternatively to avoid the voltage instability due to threshold voltage shift caused by one driving terminal of the dual-drive sub-circuit works for a long time.

19 Claims, 4 Drawing Sheets

(56) References Cited

U.S. PATENT DOCUMENTS

| | | | | |
|---|---|---|---|---|
| 2005/0259703 | A1* | 11/2005 | You | G09G 3/3233 372/38.07 |
| 2006/0012587 | A1 | 1/2006 | Stevenson et al. | |
| 2006/0097965 | A1 | 5/2006 | Deane et al. | |
| 2006/0145968 | A1* | 7/2006 | You | G09G 3/3233 345/76 |
| 2006/0221004 | A1* | 10/2006 | You | G09G 3/3233 345/76 |
| 2007/0139314 | A1* | 6/2007 | Park | G09G 3/3233 345/76 |
| 2007/0164938 | A1* | 7/2007 | Shin | G09G 3/3233 345/76 |
| 2009/0303220 | A1* | 12/2009 | You | G09G 3/3233 345/211 |
| 2011/0279422 | A1* | 11/2011 | Byun | G09G 3/3208 345/204 |

FOREIGN PATENT DOCUMENTS

| | | | |
|---|---|---|---|
| CN | 103021336 | A | 4/2013 |
| CN | 103050080 | A | 4/2013 |
| CN | 103927991 | A | 7/2014 |
| CN | 104050927 | A | 9/2014 |
| CN | 105654901 | A | 6/2016 |
| CN | 105741779 | A | 7/2016 |
| CN | 106097959 | A | 11/2016 |
| CN | 105185304 | B | 9/2017 |

OTHER PUBLICATIONS

Office Action dated Jun. 27, 2019, issued in counterpart CN Application No. 201710046234.3, with English translation (10 pages).

* cited by examiner

PIXEL CIRCUIT, DRIVING METHOD THEREOF, ELECTROLUMINESCENT PANEL AND DISPLAY DEVICE

FIELD OF THE DISCLOSURE

The disclosure relates to a luminescent technical field, and more particularly to a pixel circuit, a driving method thereof, an electroluminescent panel and a display device.

BACKGROUND

Organic Light Emitting Diode (OLED) can be classified to two types as passive matrix OLED (PMOLED) and active matrix OLED (AMOLED) according to the driving mode. AMOLED includes pixels arranged in matrix, and is belonged to active display type with high luminous efficacy, high contrast, wide view angle, and other advantages. AMOLED usually is used in high-definition display device with large size. A usual AMOLED pixel circuit is the current mode driving circuit when there is current flowing through OLED, and the OLED emits light. And changing the luminance of pixel grayscale can be achieved by controlling the amount of current flowing through the OLED itself.

SUMMARY

Embodiments of the disclosure provide a pixel circuit, including comprising: a first switch sub-circuit having a first signal control terminal coupled to a first gate line signal terminal, a first signal input terminal coupled to a data line signal terminal, and a first signal output terminal coupled to a first node, and configured to transmit a data signal provided by the data line signal terminal to the first node under controlling of a first gate line scanning signal input from the first gate line signal terminal; a second switch sub-circuit having a second signal control terminal coupled to a second gate line signal terminal, a second signal input terminal coupled to the data line signal terminal, and a second signal output terminal coupled to a second node, and configured to transmit the data signal provided by the data line signal terminal to the second node under controlling of a second gate line scanning signal input from the second gate line signal terminal; a dual-drive sub-circuit having a first driving terminal coupled to the first node, a second driving terminal coupled to the second node, a drive signal input terminal coupled to a first reference signal terminal, and a drive signal output terminal coupled to a luminescent sub-circuit, and configured to drive the luminescent sub-circuit to emit light based on a voltage level of the first node and a voltage level of the second node.

In an embodiment of the disclosure, the dual-drive sub-circuit comprises: a dual-gate thin film transistor comprising a first gate electrode, a second gate electrode, a source electrode, and a drain electrode, wherein the first gate electrode is coupled to the first node, the second gate electrode is coupled to the second node, the source electrode is coupled to the first reference signal terminal, and the drain electrode is coupled to the second reference signal terminal; a first capacitor is coupled between the first node and the drain electrode of the dual-gate thin film transistor; a second capacitor is coupled between the second node and the drain electrode of the dual-gate thin film transistor.

In an embodiment of the disclosure, the first switch sub-circuit comprises a first thin film transistor; a gate electrode of the first thin film transistor is coupled to the first gate line signal terminal, a source electrode of the first thin film transistor is coupled to the data line signal terminal, a drain electrode of the first thin film transistor is coupled to the first node.

In an embodiment of the disclosure, the second switch sub-circuit comprises a second thin film transistor; a gate electrode of the second thin film transistor is coupled to the second gate line signal terminal, a source electrode of the second thin film transistor is coupled to the data line signal terminal, a drain electrode of the second thin film transistor is coupled to the second node.

In an embodiment of the disclosure, the luminescent sub-circuit comprises an organic light-emitting diode (OLED) having a first terminal coupled to the drive signal output terminal of the dual-drive sub-circuit and a second terminal coupled to a second reference signal terminal, the OLED being configured to emit light induced by a driving current provided by the dual-drive sub-circuit.

In an embodiment of the disclosure, the luminescent sub-circuit comprises an organic light-emitting diode (OLED) having a first terminal coupled to the drive signal input terminal of the dual-drive sub-circuit and a second terminal coupled to a first reference signal terminal, the OLED being configured to emit light induced by a driving current provided by the dual-drive sub-circuit.

In an embodiment of the disclosure, the first gate line scanning signal input from the first gate line signal terminal is a high level signal to control the data signal provided by the data line signal terminal transmitted to the first node in a first period and the second gate line scanning signal input from the second gate line signal terminal is a high level signal to control the data signal provided by the data line signal terminal transmitted to the second node in a second period, wherein the first period and the second period are time-sequential.

In one or more optional embodiments, the first period is a first frame and the second period is a second frame.

Embodiments of the disclosure further provide a driving method of the pixel circuit provided by the embodiment of the disclosure, includes: when the first gate line signal terminal inputs the gate line scanning signal, the first switch sub-circuit transmits a data signal provided by the data line signal terminal to the first node under the controlling of a gate line scanning signal provided by the first gate line signal terminal; the dual-drive sub-circuit drives the luminescent sub-circuit to emit light when a voltage of the first node is a voltage level of the data signal provided by the data line signal terminal; when the second gate line signal terminal inputs the gate line scanning signal, the second switch sub-circuit transmits the data signal provided by the data line signal terminal to the second node, under the controlling of a gate line scanning signal provided by the second gate line signal terminal; the dual-drive sub-circuit drives the luminescent sub-circuit to emit light when a voltage of the second node is the voltage level of the data signal provided by the data line signal terminal.

In an embodiment of the disclosure, further comprising: alternatively receiving the gate line scanning signal from the first gate line signal terminal and the second gate line signal terminal during a preset first time period.

In an embodiment of the disclosure, the first switch sub-circuit and the second switch sub-circuit are configured to work alternatively.

In an embodiment of the disclosure, the first driving terminal and the second driving terminal are configured to work alternatively on two frames separated by a preset time lag.

Embodiments of the disclosure further provide an electroluminescent panel, the electroluminescent panel a matrix of pixel circuits, each pixel circuit in the matrix comprising: a first switch sub-circuit having a first signal control terminal coupled to a first gate line signal terminal, a first signal input terminal coupled to a data line signal terminal, and a first signal output terminal coupled to a first node, and configured to transmit a data signal provided by the data line signal terminal to the first node under controlling of a first gate line scanning signal input from the first gate line signal terminal; a second switch sub-circuit having a second signal control terminal coupled to a second gate line signal terminal, a second signal input terminal coupled to the data line signal terminal, and a second signal output terminal coupled to a second node, and configured to transmit the data signal provided by the data line signal terminal to the second node under controlling of a second gate line scanning signal input from the second gate line signal terminal; a dual-drive sub-circuit having a first driving terminal coupled to the first node, a second driving terminal coupled to the second node, a drive signal input terminal coupled to a first reference signal terminal, and a drive signal output terminal coupled to a luminescent sub-circuit, and configured to drive the luminescent sub-circuit to emit light based on a voltage level of the first node and a voltage level of the second node.

In an embodiment of the disclosure, the dual-drive sub-circuit comprises: a dual-gate thin film transistor comprising a first gate electrode, a second gate electrode, a source electrode, and a drain electrode, wherein the first gate electrode is coupled to the first node, the second gate electrode is coupled to the second node, the source electrode is coupled to the first reference signal terminal, and the drain electrode is coupled to the second reference signal terminal; a first capacitor is connected coupled between the first node and the drain electrode of the dual-gate thin film transistor, a second capacitor is connected coupled between the second node and the drain electrode of the dual-gate thin film transistor.

In an embodiment of the disclosure, the first switch sub-circuit comprises a first thin film transistor, a gate electrode of the first thin film transistor is coupled to the first gate line signal terminal, a source electrode of the first thin film transistor is coupled to the data line signal terminal, a drain electrode of the first thin film transistor is coupled to the first node.

In an embodiment of the disclosure, the second switch sub-circuit comprises a second thin film transistor, a gate electrode of the second thin film transistor is coupled to the second gate line signal terminal, a source electrode of the second thin film transistor is coupled to the data line signal terminal, a drain electrode of the second thin film transistor is coupled to the second node.

In an embodiment of the disclosure, further comprising a controller configured to apply a first high level signal in a first period to the first node via the first gate line signal terminal and apply a second high level signal in a second period to the second node via the second gate line signal terminal, wherein the first period and the second period are time-sequential.

In an embodiment of the disclosure, the first period is a first frame and the second period is a second frame.

Embodiments of the disclosure further provide a display device, the electroluminescent panel includes the electroluminescent pane provided by the embodiment of the disclosure. It is to be understood that both the foregoing general description and the following detailed description are exemplary only and are not restrictive of the present disclosure.

Figure 1:
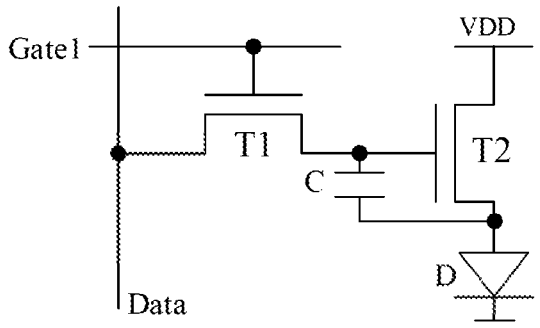
FIG. 1 (Related Art)
FIG. 1 is a structure diagram of a pixel circuit according to the related art.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples of the present disclosure. Also, common but well-understood elements that are useful or necessary in a commercially feasible example are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above, except where different specific meanings have otherwise been set forth herein.

DETAILED DESCRIPTION OF PREFERRED EMBODIMENTS

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference throughout this specification to "one embodiment," "an embodiment," "exemplary embodiment," or the like in the singular or plural means that one or more particular features, structures, or characteristics described in connection with an example is included in at least one embodiment of the present disclosure. Thus, the appearances of the phrases "in one embodiment" or "in an embodiment,"

"in an exemplary embodiment," or the like in the singular or plural in various places throughout this specification are not necessarily all referring to the same embodiment. Furthermore, the particular features, structures, or characteristics in one or more embodiments may be combined in any suitable manner.

In general, a basic structure of a typical AMOLED pixel circuit is a 2T1C structure as shown in FIG. 1, which includes two thin film transistors (TFTs) and one capacitor. When the pixel circuit is working, a gate scanning signal Gate1 input from a gate line signal terminal controls a switch thin film transistor T1 to turn on, a data signal Data input from a data line signal terminal is transmitted to a gate electrode of a drive thin film transistor T2 via the switch thin film transistor T1 and charges the capacitor C1. When the drive thin film transistor T2 is turned on, the OLED D is driven to emit light. Furthermore, under the effect of the capacitor, the voltage level of the gate electrode of the drive thin film transistor T2 can be maintained until the next picture is switched, which ensures the pictures are continuous.

However, because the drive thin film transistor T2 of the pixel circuit is effected at bias voltage status for a long time, a threshold voltage of the drive thin film transistor T2 would be shifted. The threshold shift may make the luminance of the OLED D changes undesirably and may cause various kinds of defect of the display.

Based on this background, how to suppress the threshold voltage of the drive thin film transistor from shifting, ensure the stability of the luminance of the grayscale, and prevent the occurrence of defect of display, are technical problems need to be resolved.

The disclosure has following beneficial effects. The disclosure provides a pixel circuit, a driving method thereof, an electroluminescent panel, and a display device. The pixel circuit includes the first switch sub-circuit, the second switch sub-circuit, the luminescent sub-circuit, and the dual-drive sub-circuit. The first driving terminal of the dual-drive sub-circuit is connected to the first node, the second driving terminal of the dual-drive sub-circuit is connected to the second node, the signal input terminal of the dual-drive sub-circuit is connected to the first reference signal terminal, and the signal output terminal of the dual-drive sub-circuit is connected to the first port of the luminescent sub-circuit. The second port of the luminescent sub-circuit is connected to the second reference signal terminal. The dual-drive sub-circuit is used to drive the luminescent sub-circuit to emit light under the controlling of the voltage level of the first node or the second node. Therefore, through improving the pixel circuit, the first driving terminal of the dual-drive sub-circuit connects to the first node, the second driving terminal of the dual-drive sub-circuit connects to the second node, when the first gate line signal terminal and the second gate line signal terminal input the gate line scanning signal alternatively, the first switch sub-circuit and the second switch sub-circuit are working alternatively, cause the first driving terminal and the second driving terminal of the dual-drive sub-circuit are working alternatively, thus to drive the luminescent sub-circuit to emit light. Therefore, through the two driving terminals work alternatively, avoiding the voltage instability due to one driving terminal of the dual-drive sub-circuit works for a long time, ensuring the stability of pixel grayscale luminance, eliminating the defect of display.

Embodiments of a pixel circuit, a driving method thereof, an electroluminescent panel, and a display device of the disclosure will be described in detail with reference to the accompanying drawings as follows.

Figure 2A:
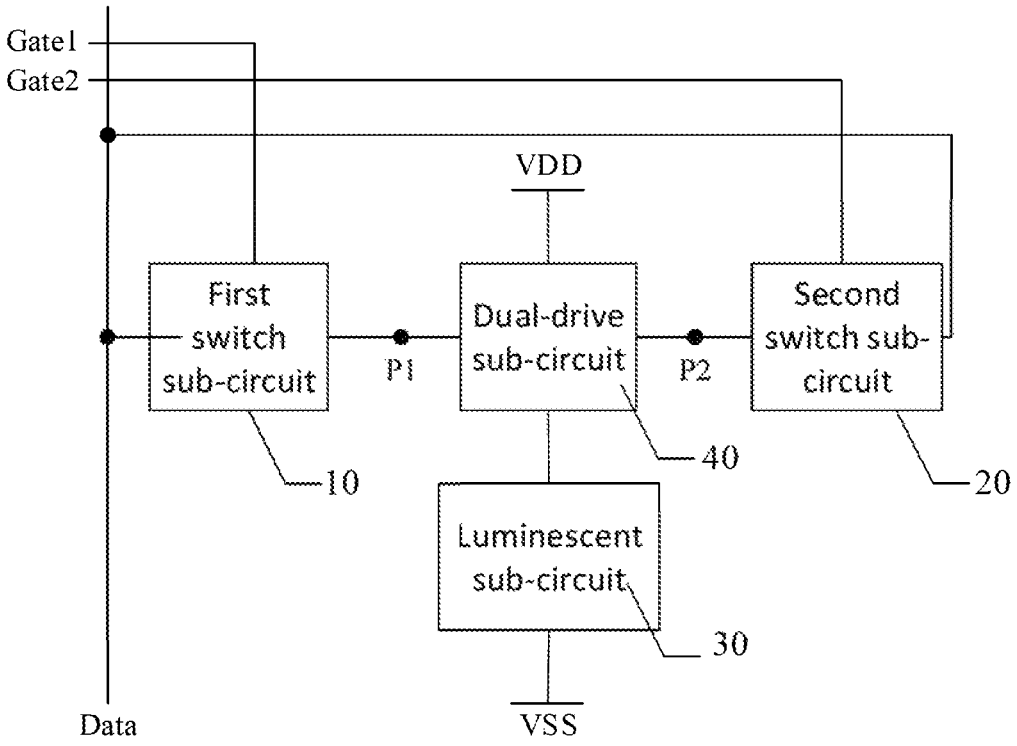
FIG. 2A is a structure diagram of a pixel circuit according to one embodiment of the disclosure.
Figure 2B:
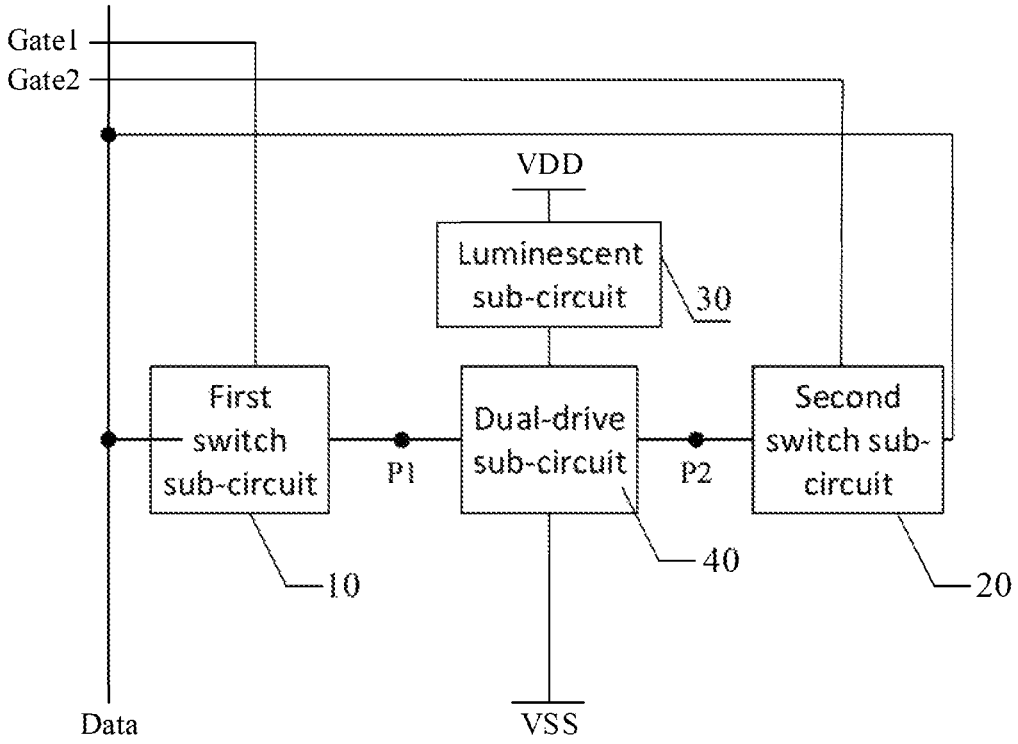
FIG. 2B is a structure diagram of a pixel circuit according to another embodiment of the disclosure.

As shown in FIG. 2A and FIG. 2B, the pixel circuit includes: a first switch sub-circuit 10, a second switch sub-circuit 20, a luminescent sub-circuit 30, and a dual-drive sub-circuit 40.

A signal control terminal of the first switch sub-circuit 10 is connected to a first gate line signal terminal Gate1, a signal input terminal of the first switch sub-circuit 10 is connected to a data line signal terminal (labeled as Data), a signal output terminal of the first switch sub-circuit 10 is connected to a first node P1. The first switch sub-circuit 10 is used to transmit a data signal provided by the data line signal terminal (labeled as Data) to the first node P1, under the controlling of a gate line scanning signal input from the first gate line signal terminal Gate1.

A signal control terminal of the second switch sub-circuit 20 is connected to a second gate line signal terminal Gate2, a signal input terminal of the second switch sub-circuit 20 is connected to the data line signal terminal (labeled as Data), a signal output terminal of the second switch sub-circuit 20 is connected to a second node P2. The second switch sub-circuit 20 is used to transmit the data signal provided by the data line signal terminal (labeled as Data) to the second node P2, under the controlling of a gate line scanning signal input from the second gate line signal terminal Gate2.

As shown in FIG. 2A, a first driving terminal of the dual-drive sub-circuit 40 is connected to the first node P1, a second driving terminal of the dual-drive sub-circuit 40 is connected to the second node P2, a signal input terminal of the dual-drive sub-circuit 40 is connected to a first reference signal terminal VDD, and a signal output terminal of the dual-drive sub-circuit 40 is connected to a first port of the luminescent sub-circuit 30. A second port of the luminescent sub-circuit 30 is connected to a second reference signal terminal GND. The dual-drive sub-circuit 40 is used to drive the luminescent sub-circuit 30 to emit light under the controlling of a voltage level of the first node P1 or the second node P2.

As shown in FIG. 2B, a first driving terminal of the dual-drive sub-circuit 40 is connected to the first node P1, a second driving terminal of the dual-drive sub-circuit 40 is connected to the second node P2, a signal input terminal of the dual-drive sub-circuit 40 is connected to a first port of the luminescent sub-circuit 30, and a signal output terminal of the dual-drive sub-circuit 40 is connected to a second reference signal terminal GND. A second port of the luminescent sub-circuit 30 is connected to a first reference signal terminal VDD. The dual-drive sub-circuit 40 is used to drive the luminescent sub-circuit 30 to emit light under the controlling of a voltage level of the first node P1 or the second node P2.

The disclosure provides a new pixel circuit that includes the dual-drive sub-circuit 40. The first driving terminal of the dual-drive sub-circuit 40 connects to the first node P while the second driving terminal of the dual-drive sub-circuit 40 connects to the second node P2. When the first gate line signal terminal Gate1 and the second gate line signal terminal Gate2 input the gate line scanning signal alternatively, the first switch sub-circuit 10 and the second switch sub-circuit 20 are working alternatively, which cause the first driving terminal and the second driving terminal of the dual-drive sub-circuit 40 work alternatively to drive the luminescent sub-circuit 30 to emit light. For example, the first gate line scanning signal input from the first gate line signal terminal Gate1 is a high level signal to control the data signal provided by the data line signal terminal (labeled as Data) transmitted to the first node in a first period and the second gate line scanning signal input from the second gate line signal terminal Gate2 is a high level signal to control the data signal provided by the data line signal terminal transmitted to the second node in a second period, wherein the first period and the second period are time-sequential. For example, the first period is a first frame and the second period is a second frame. For example, the first period is a first frame and the second period is a third frame. Therefore, the threshold voltage shift of the dual-drive sub-circuit 40 is greatly reduced by adopting two driving terminals work alternatively. The new pixel circuit avoids the voltage instability due to one driving terminal of the dual-drive sub-circuit 40 works for a long time, ensures the stability of pixel grayscale luminance, and eliminates the defect of display.

Figure 3A:
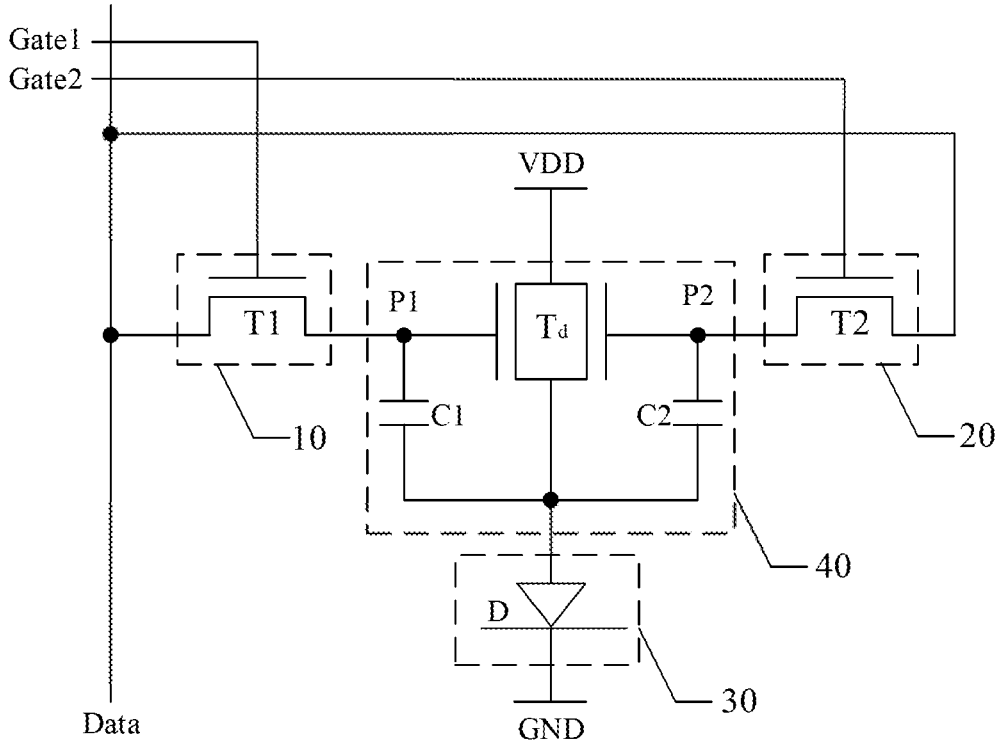
FIG. 3A is a detail structure diagram of a pixel circuit according to another embodiment of the disclosure.
Figure 3B:
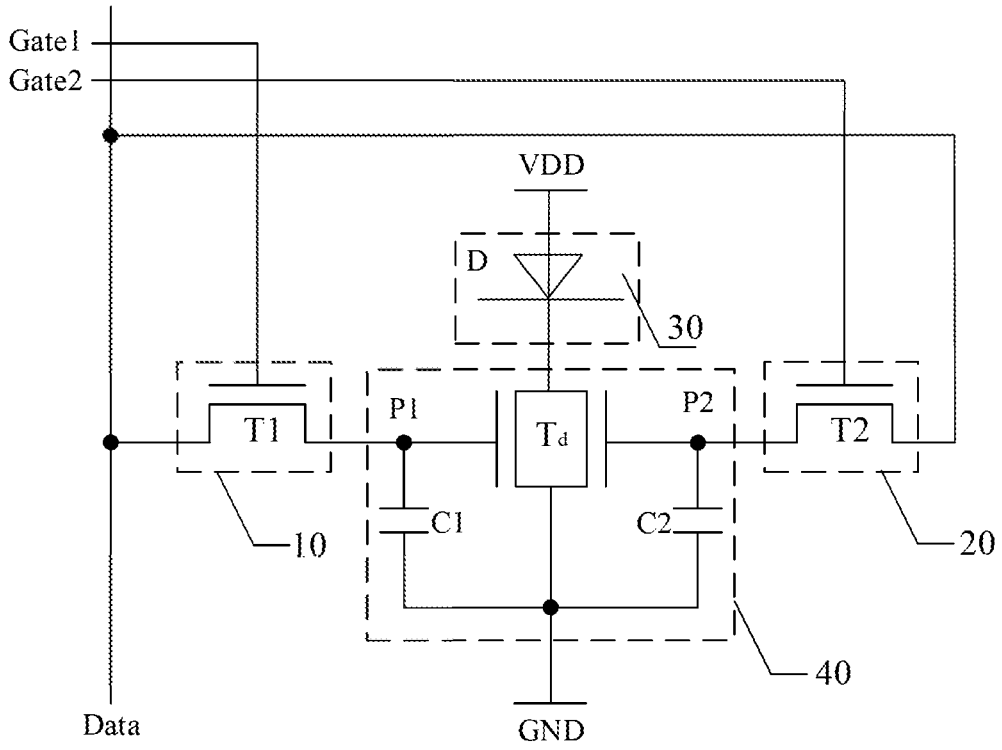
FIG. 3B is a detail structure diagram of a pixel circuit according to one embodiment of the disclosure.

A detail implementation is provided clearly describe the two driving terminal of the dual-drive sub-circuit 40 how to work alternatively. As shown in FIG. 3A, the dual-drive sub-circuit 40 includes: a dual-gate thin film transistor Td, a first capacitor C1, and a second capacitor C2. The luminescent sub-circuit comprises an organic light-emitting diode (OLED) having a first terminal coupled to the drive signal output terminal of the dual-drive sub-circuit and a second terminal coupled to a second reference signal terminal GND, the OLED D being configured to emit light induced by a driving current provided by the dual-drive sub-circuit. For example, the first terminal of the OLED D is an anode and the second terminal of the OLED D is a cathode. As shown in FIG. 3B, The luminescent sub-circuit comprises an organic light-emitting diode (OLED) having a first terminal coupled to the drive signal input terminal of the dual-drive sub-circuit and a second terminal coupled to a first reference signal terminal VDD, the OLED D being configured to emit light induced by a driving current provided by the dual-drive sub-circuit. For example, the first terminal of the OLED D is a cathode and the second terminal of the OLED D is an anode.

As shown in FIG. 3A, a first gate electrode of the dual-gate thin film transistor Td is connected to the first node P1, a second gate electrode of the dual-gate thin film transistor Td is connected to the second node P2, a source electrode of the dual-gate thin film transistor Td is connected to the first reference signal terminal VDD, and a drain electrode of the dual-gate thin film transistor Td is connected to the anode of the OLED D.

The first capacitor C1 is connected between the first node P1 and the anode of the OLED D.

The second capacitor C2 is connected between the second node P2 and the anode of the OLED D.

As shown in FIG. 3B, a first gate electrode of the dual-gate thin film transistor Td is connected to the first node P1, a second gate electrode of the dual-gate thin film transistor Td is connected to the second node P2, a source electrode of the dual-gate thin film transistor Td is connected to the cathode of the OLED D, and a drain electrode of the dual-gate thin film transistor Td is connected to the second reference signal terminal GND, the anode of the OLED D is connected to the first reference signal terminal VDD.

The first capacitor C1 is connected between the first node P1 and the second reference terminal GND.

The second capacitor C2 is connected between the second node P2 and the second reference terminal GND.

In detail, the working principle of the dual-gate thin film transistor Td to suppress the threshold voltage to shift, can be described in combine with a threshold voltage shift experience formula as shown in below:

$$\Delta V_{th} \propto |V_{gate}|^{\beta} t^{\gamma}.$$

Therein, $\Delta V_{th}$ represents a shift value of the threshold voltage, $V_{gate}$ represents the voltage of the gate electrode, t represents time, β and γ represent constant related to the character of the thin film transistor itself.

In the pixel circuit provided in the embodiment of the disclosure, take the first gate electrode of the dual-gate thin film transistor Td is working in a first frame and the second gate electrode of the dual-gate thin film transistor Td is working in a second frame adjacent to the first frame as example. The threshold voltage shift value of the first gate electrode of the dual-gate thin film transistor Td is equal to $k1\times|V_{data1}|^{\beta 1}t^{\gamma 1}$, K1 is a constant. The threshold voltage shift value of the second gate electrode of the dual-gate thin film transistor Td is equal to $k2\times|V_{data1}|^{\beta 1}t^{\gamma 1}$, K2 is a constant. A bias voltage of the first gate electrode in the first frame and a bias voltage of the second gate electrode in the second frame produce opposite effect to the channel of the thin film transistor, therefore, after two frame signals are applied completely, the threshold voltage shift value is $k1\times|V_{data1}|^{\beta 1}t^{\gamma 1}-k2\times|V_{data2}|^{\beta 2}t^{\gamma 2}$. In detail, the parameters β and γ can be adjusted to consistent with each other, namely data1 is equal to data2, via manufacturing technology for manufacturing the thin film transistor, thus to make the threshold voltage shift value near to zero after the two frame signals are applied completely. Thus achieving the threshold voltage shift value of a couple of odd-even frames to be counteracted due to the first gate electrode and second gate electrode work alternatively, and avoiding the luminance to be changed due to the electrical property of the thin film transistor is changed.

Of course, the first gate electrode and second gate electrode work alternatively, are not limited in two consecutive frames, the first gate electrode and second gate electrode can work alternatively in two frames that are not adjacent, which are not limited by the examples in the disclosure.

In detail, the data signal provided by the data line signal terminal (labeled as Data) is a high level signal, the dual-gate thin film transistor Td is a N-type (N-channel) thin film transistor; or, the data signal provided by the data line signal terminal (labeled as Data) is a low level signal, the dual-gate thin film transistor Td is a P-type (P-channel) thin film transistor.

The detail structure of the dual-drive sub-circuit 40 as described above is just an example, when in implementation, the structure of the dual-drive sub-circuit 40 is not limited to the above structure of the example, and can be other structures known by the persons in related technical field.

The first reference signal terminal is a high level terminal, and the voltage of it can be voltage VDD, the second reference signal terminal is a low level terminal, and the voltage of it can be grounded voltage GND or VSS. Therein VDD>GND>VSS.

In one implementation, in the pixel circuit provided in the embodiment of the disclosure, as shown in FIG. 3A and FIG. 3B, the first switch sub-circuit 10 may include a first thin film transistor T1.

A gate electrode of the first thin film transistor T1 is connected to the first gate line signal terminal Gate1, a source electrode of the first thin film transistor T1 is connected to the data line signal terminal (labeled as Data), a drain electrode of the first thin film transistor T1 is connected to the first node P1.

In one or more embodiments, the first thin film transistor T1 can transmit the data signal provided by the data line signal terminal (labeled as Data) to the first node P1, under the controlling of the gate line scanning signal input from the first gate line signal terminal Gate1.

Furthermore, the gate line scanning signal input from the first gate line signal terminal Gate1 is the high level signal, the first thin film transistor T1 is N-type thin film transistor; or, the gate line scanning signal input from the first gate line signal terminal Gate1 is the low level signal, the first thin film transistor T1 is P-type thin film transistor.

The detail structure of the first switch sub-circuit 10 as described above is just an example, the structure of the first switch sub-circuit 10 is not limited to the above structure of the example, and can be other structures known by a person having ordinary skill in related technical field.

In one implementation, in the pixel circuit provided in the embodiment of the disclosure, as shown in FIG. 3A and FIG. 3B, the second switch sub-circuit 20 may include a second thin film transistor T2.

A gate electrode of the second thin film transistor T2 is connected to the second gate line signal terminal Gate2, a source electrode of the second thin film transistor T2 is connected to the data line signal terminal (labeled as Data), a drain electrode of the second thin film transistor T2 is connected to the second node P2.

In one or more embodiments, the second thin film transistor T2 may transmit the data signal provided by the data line signal terminal (labeled as Data) to the second node P2, under the controlling of the gate line scanning signal input from the second gate line signal terminal Gate2.

Furthermore, the gate line scanning signal input from the second gate line signal terminal Gate2 is the high level signal when the second thin film transistor T2 is N-type thin film transistor. Alternatively, the gate line scanning signal input from the second gate line signal terminal Gate2 is the low level signal when the second thin film transistor T2 is P-type thin film transistor.

The detail structure of the second switch sub-circuit 20 as described above is just an example, the structure of the second switch sub-circuit 20 is not limited to the above structure of the example, and can be other structures known by the persons in related technical field.

Of course, the transistors referred in the above pixel circuit of the embodiment of the disclosure are not limited to thin film transistors, the transistors also can be metal-oxide-semiconductor field effect transistor (MOSFET). And the manufacturing technology of the source electrode and drain electrode of each thin film transistor (include the first thin film transistor, the second thin film transistor, and the dual-gate thin film transistor Td) can be the same, and the name of the source electrode and drain electrode of each thin film transistor described above can be interchanged, namely the name of the source electrode and drain electrode of each thin film transistor can be changed according to the voltage direction for the thin film transistor.

In detail, in order to achieve light emitting function, in the pixel circuit provided in the disclosure, as shown in FIG. 3A and FIG. 3B, the luminescent sub-circuit 30 may include organic light emitting diode (OLED) D.

As shown in FIG. 3A, a first terminal of the OLED D is connected to the signal output terminal of the dual-gate thin film transistor Td, a second terminal of the OLED D is connected to the second reference signal terminal GND.

Of course, although the OLED D referred in the pixel circuit provided in the embodiment of the disclosure is active matrix electroluminescent component, the OLED D may be replaced by quantum light emitting diode (QLED) or other type of light emitting diode.

It is necessary to note that, the improvements of the pixel circuit provided by the embodiment of the disclosure, are not limited to the structure shown in FIG. 3A and FIG. 3B, the pixel circuit may be implemented with other structures, which are not limited in the disclosure.

Figure 4:
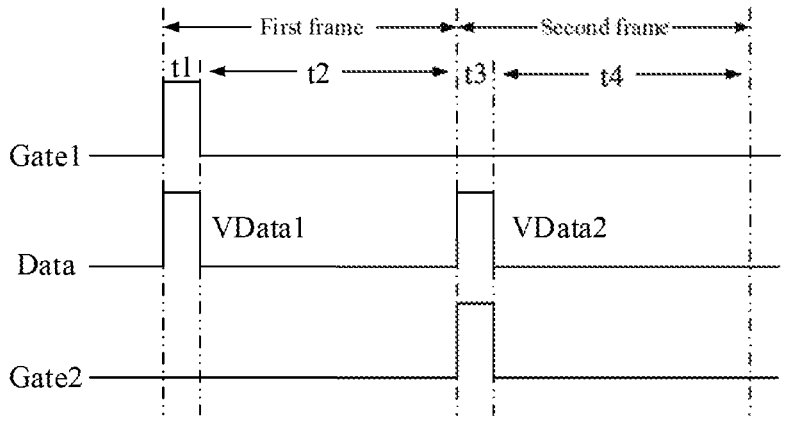
FIG. 4 is a timing sequence diagram when the pixel circuit is working, corresponding to the pixel circuit shown in FIG. 3A and FIG. 3B, according to one embodiment of the disclosure.

The working process of the above pixel circuit provided in the disclosure is described below, in combination with the pixel circuit as shown in FIG. 3A and working timing sequence diagram of the pixel circuit as shown in FIG. 4.

FIG. 4 is a timing sequence diagram of the pixel circuit provided in the one or more embodiments of the disclosure, where each frame of two consecutive frames is divided to two phases. The pixel circuit as shown in FIG. 3A, take each thin film transistor is N-type thin film transistor, the voltage of the first reference signal terminal is grounded voltage GND, and the voltage of the second reference signal terminal is VDD as example.

In the first phase as marked by t1, the first gate line signal terminal Gate1 inputs the gate line scanning signal, the first thin film transistor T1 is turned on and transmits the data signal VData1 provided by the data line signal terminal (labeled as Data) to the first node P1, and charges the first capacitor C1 simultaneously. At this time, the first gate electrode of the dual-gate thin film transistor Td is turned on and maintains the voltage of the cathode of the OLED D at low level, because the voltage of the anode of the OLED D is high level, thus driving the OLED D to emit light.

In the second phase as marked by t2, the first gate line signal terminal Gate1 stops inputting the gate line scanning signal, the first thin film transistor T1 is turned off, at this time, the first capacitor C1 is discharged, the first gate electrode of the dual-gate thin film transistor Td is turned on continuously, and maintains the voltage of the cathode of the OLED D at low level continuously, thus driving the OLED D to emit light continuously.

In the third phase as marked by t3, the second gate line signal terminal Gate2 inputs the gate line scanning signal, the second thin film transistor T2 is turned on and transmits the data signal VData2 provided by the data line signal terminal (labeled as Data) to the second node P2, and charges the second capacitor C2 simultaneously. At this time, the second gate electrode of the dual-gate thin film transistor Td is turned on and causes the voltage of the cathode of the OLED D at low level, thus driving the OLED D to emit light.

In the fourth phase as marked by t4, the second gate line signal terminal Gate2 stops inputting the gate line scanning signal, the second thin film transistor T2 is turned off, at this time, the second capacitor C2 is discharged. At this time, the second gate electrode of the dual-gate thin film transistor Td is turned on continuously, and maintains the voltage of the cathode of the OLED D at low level continuously, thus driving the OLED D to emit light continuously.

The above four phases may repeat themselves. The first two phases t1 and t2 may constitute a first frame. The last two phases 3 and t4 may constitute a second frame. The first two phases t1 and t2 may not be directly adjacent to the last two phases t3 and t4. In other words, the two frames may not be next to each other. For example, the first two phases t1 and t2 may constitute a first frame, the last two phases t3 and t4 may constitute a third frame.

When the next t1 phase comes, namely the first gate line signal terminal Gate1 inputs the gate line scanning signal again, the first thin film transistor T1 is turned on and the second thin film transistor T2 is turned off. Therefore, the dual-drive sub-circuit utilizes the first thin film transistor T1 and the second thin film transistor T2 to work alternatively.

Accordingly, the first gate electrode and the second gate electrode of the dual-gate thin film transistor Td are caused to work alternatively, which avoids the threshold voltage to shift due to one gate electrode works for a long time. Therefore, the dual-drive sub-circuit ensures the stability of pixel grayscale luminance and eliminates the potential defect of display caused by threshold voltage shift.

Based on the same conception, the embodiments of the disclosure further provide a driving method for the above pixel circuit provided by the disclosure, the driving method may include:

When the first gate line signal terminal inputs the gate line scanning signal, the first switch sub-circuit transmits data signal provided by the data line signal terminal to the first node, under the controlling of gate line scanning signal provided by the first gate line signal terminal; the dual-gate thin film transistor drives the luminescent sub-circuit to emit light when the voltage of the first node is the voltage level of the data signal provided by the data line signal terminal.

When the second gate line signal terminal inputs the gate line scanning signal, the second switch sub-circuit transmits data signal provided by the data line signal terminal to the second node, under the controlling of gate line scanning signal provided by the second gate line signal terminal; the dual-gate thin film transistor drives the luminescent sub-circuit to emit light when the voltage of the second node is the voltage level of the data signal provided by the data line signal terminal.

Based on the same conception, the embodiments of the disclosure further provides a electroluminescent panel, the electroluminescent panel can include at least one pixel circuit provided by at least embodiments of the disclosure. The embodiments of the electroluminescent panel can refer to descriptions of the pixel circuit of the embodiments of the disclosure, here does not describe again.

Embodiments of the disclosure further provide an electroluminescent panel, the electroluminescent panel a matrix of pixel circuits, each pixel circuit in the matrix comprising: a first switch sub-circuit having a first signal control terminal coupled to a first gate line signal terminal, a first signal input terminal coupled to a data line signal terminal, and a first signal output terminal coupled to a first node, and configured to transmit a data signal provided by the data line signal terminal to the first node under controlling of a first gate line scanning signal input from the first gate line signal terminal; a second switch sub-circuit having a second signal control terminal coupled to a second gate line signal terminal, a second signal input terminal coupled to the data line signal terminal, and a second signal output terminal coupled to a second node, and configured to transmit the data signal provided by the data line signal terminal to the second node under controlling of a second gate line scanning signal input from the second gate line signal terminal; a dual-drive sub-circuit having a first driving terminal coupled to the first node, a second driving terminal coupled to the second node, a drive signal input terminal coupled to a first reference signal terminal, and a drive signal output terminal coupled to a luminescent sub-circuit, and configured to drive the luminescent sub-circuit to emit light based on a voltage level of the first node and a voltage level of the second node.

In an embodiment of the disclosure, the dual-drive sub-circuit comprises: a dual-gate thin film transistor comprising a first gate electrode, a second gate electrode, a source electrode, and a drain electrode, wherein the first gate electrode is coupled to the first node, the second gate electrode is coupled to the second node, the source electrode is coupled to the first reference signal terminal, and the drain electrode is coupled to the second reference signal terminal; a first capacitor is connected coupled between the first node and the drain electrode of the dual-gate thin film transistor, a second capacitor is connected coupled between the second node and the drain electrode of the dual-gate thin film transistor.

In an embodiment of the disclosure, the first switch sub-circuit comprises a first thin film transistor, a gate electrode of the first thin film transistor is coupled to the first gate line signal terminal, a source electrode of the first thin film transistor is coupled to the data line signal terminal, a drain electrode of the first thin film transistor is coupled to the first node.

In an embodiment of the disclosure, the second switch sub-circuit comprises a second thin film transistor, a gate electrode of the second thin film transistor is coupled to the second gate line signal terminal, a source electrode of the second thin film transistor is coupled to the data line signal terminal, a drain electrode of the second thin film transistor is coupled to the second node.

In an embodiment of the disclosure, further comprising a controller configured to apply a first high level signal in a first period to the first node via the first gate line signal terminal and apply a second high level signal in a second period to the second node via the second gate line signal terminal, wherein the first period and the second period are time-sequential.

In an embodiment of the disclosure, the first period is a first frame and the second period is a second frame.

The embodiments of the disclosure further provides a display device, the display device can include the electroluminescent panel provided in the disclosure. The display device can be a mobile phone, a tablet computer, a television, a monitor, a portable computer, a digital camera, a navigator, and any devices and components including display function. The embodiments of the display device can refer to descriptions of the electroluminescent panel of the disclosure, here does not describe again.

The embodiment of the disclosure provides a novel pixel circuit, a novel driving method thereof, an electroluminescent panel, and a display device. The pixel circuit includes the first switch sub-circuit, the second switch sub-circuit, the luminescent sub-circuit, and the dual-drive sub-circuit. The first driving terminal of the dual-drive sub-circuit is connected to the first node, the second driving terminal of the dual-drive sub-circuit is connected to the second node, the signal input terminal of the dual-drive sub-circuit is connected to the first reference signal terminal VDD, and the signal output terminal of the dual-drive sub-circuit is connected to the first port of the luminescent sub-circuit. The second port of the luminescent sub-circuit is connected to the second reference signal terminal. The dual-drive sub-circuit is used to drive the luminescent sub-circuit to emit light under the controlling of voltage level of the first node or the second node. Therefore, through improving the pixel circuit, the first driving terminal of the dual-drive sub-circuit connects to the first node, the second driving terminal of the dual-drive sub-circuit connects to the second node, when the first gate line signal terminal and the second gate line signal terminal input the gate line scanning signal alternatively, the first switch sub-circuit and the second switch sub-circuit are working alternatively, cause the first driving terminal and the second driving terminal of the dual-drive sub-circuit are working alternatively, thus to drive the luminescent sub-circuit to emit light. Therefore, through the two driving terminals work alternatively, avoiding the voltage instability due to one driving terminal of the dual-drive sub-circuit works for a long time, ensuring the stability of pixel gray-scale luminance, eliminating the defect of display.

The disclosed above is merely example embodiments of the disclosure, which does not limit the protection scope of the disclosure. Equivalent modification within the spirit of the claims of the disclosure should be covered by the protected scope of the disclosure.

What is claimed is:

1. A pixel circuit in a luminescent panel, comprising:

a first switch sub-circuit having a first signal control terminal coupled to a first gate line signal terminal, a first signal input terminal coupled to a data line signal terminal, and a first signal output terminal coupled to a first node, and configured to transmit a data signal provided by the data line signal terminal to the first node under controlling of a first gate line scanning signal input from the first gate line signal terminal;

a second switch sub-circuit having a second signal control terminal coupled to a second gate line signal terminal, a second signal input terminal coupled to the data line signal terminal, and a second signal output terminal coupled to a second node, and configured to transmit the data signal provided by the data line signal terminal to the second node under controlling of a second gate line scanning signal input from the second gate line signal terminal;

a dual-drive sub-circuit having a first driving terminal coupled to the first node, a second driving terminal coupled to the second node, a drive signal input terminal coupled to a first reference signal terminal, and a drive signal output terminal coupled to a luminescent sub-circuit, and configured to drive the luminescent sub-circuit to emit light based on a voltage level of the first node and a voltage level of the second node;

wherein the data line signal terminal transmits the data signal to both the first node and the second node, and the first gate line scanning signal and the second gate line scanning signal alternatively control the first switch sub-circuit and the second switch sub-circuit to transmit the data signal to the first node and the second node respectively.

2. The pixel circuit according to claim 1, wherein the dual-drive sub-circuit comprises:

a dual-gate thin film transistor comprising a first gate electrode, a second gate electrode, a source electrode, and a drain electrode, wherein the first gate electrode is coupled to the first node, the second gate electrode is coupled to the second node, the source electrode is coupled to the first reference signal terminal, and the drain electrode is coupled to a second reference signal terminal;

a first capacitor is coupled between the first node and the drain electrode of the dual-gate thin film transistor;

a second capacitor is coupled between the second node and the drain electrode of the dual-gate film transistor.

3. The pixel circuit according to claim 1. wherein the first switch sub-circuit comprises a first thin film transistor a gate electrode of the first thin film transistor is coupled to the first gate line signal terminal, a source electrode of the first thin film transistor is coupled to the data line signal terminal, a drain electrode of the first thin film transistor is coupled to the first node.

4. The pixel circuit according to claim 1, wherein the second switch sub-circuit comprises a second thin film transistor;

a gate electrode of the second thin film transistor is coupled to the second gate line signal terminal, a source electrode of the second thin film transistor is coupled to the data line signal terminal, a drain electrode of the second thin film transistor is coupled to the second node.

5. The pixel circuit of claim 1, wherein the luminescent sub-circuit comprises an organic light-emitting diode (OLED) having a first terminal coupled to the drive signal output terminal of the dual-drive sub-circuit and a second terminal coupled to a second reference signal terminal, the OLED being configured to emit light induced by a driving current provided by the dual-drive sub-circuit.

6. The pixel circuit of claim 1, wherein the luminescent sub-circuit comprises air organic light-emitting diode (OLED) having a first terminal coupled to the drive signal input terminal of the dual-drive sub-circuit and a. second terminal coupled to a first reference signal terminal, the OLED being configured to emit light induced by a driving current provided by the dual-drive sub-circuit.

7. The pixel circuit according to claim 1, wherein the first gate line scanning signal input from the first gate line signal terminal is a high level signal to control the data signal provided by the data line signal terminal transmitted to the first node in a first period and the second gate line scanning signal input from the second gate line signal terminal is a high level signal to control the data signal provided by the data line signal terminal transmitted to the second node in a second period, wherein the first period and the second period are time-sequential.

8. The pixel circuit according to claim 7, wherein the first period is a first frame and the second period is a second frame.

9. An electroluminescent panel comprising a matrix of pixel circuits, each pixel circuit in the matrix comprising:

a first switch sub-circuit having a first signal control terminal coupled to a first gate line signal terminal, a first signal input terminal coupled to a data line signal terminal, and a first signal output terminal coupled to a first node, and configured to transmit a data signal provided by the data line signal terminal to the first node under controlling of a first gate line scanning signal input from the first gate line signal terminal;

a second switch sub-circuit having a second signal control terminal coupled to a second gate line signal terminal, a second signal input terminal coupled to the data line signal terminal, and a second signal output terminal coupled to a second node, and configured to transmit the data signal provided by the data line signal terminal to the second node under controlling of a second gate line scanning signal input from the second gate line signal terminal;

a dual-drive sub-circuit having a first driving terminal coupled to the first node, a second driving terminal coupled to the second node, a drive signal input terminal coupled to a first reference signal terminal, and a drive signal output terminal coupled to a luminescent sub-circuit, and configured to drive the luminescent sub-circuit to emit light based on a voltage level of the first node and a voltage level of the second node;

wherein the data line signal terminal transmits the data signal to both the first node and the second node, and the first gate line scanning signal and the second gate line scanning signal alternatively control the first switch sub-circuit and the second switch sub-circuit to transmit the data signal to the first node and the second node respectively.

10. The electroluminescent panel according to claim 9, wherein the dual-drive sub-circuit comprises:

a dual-gate thin film transistor comprising a first gate electrode, a second gate electrode, a. source electrode, and a drain electrode, wherein the first gate electrode is coupled to the first node, the second gate electrode is coupled to the second node, the source electrode is coupled to the first reference signal terminal, and the drain electrode is coupled to a second reference signal terminal;

a first capacitor is connected coupled between the first node and the drain electrode of the dual-gate thin film transistor;

a second capacitor is connected coupled between the second node and the drain electrode of the dual-gate thin film transistor.

11. The electroluminescent panel according to claim 9, wherein the first switch sub-circuit comprises a first thin film transistor;

a gate electrode of the first thin film transistor is coupled to the first gate line signal terminal, a source electrode of the first thin film transistor is coupled to the data line signal terminal, a drain electrode of the first thin film transistor is coupled to the first node.

12. The electroluminescent panel according to claim 9, wherein the second switch sub-circuit comprises a second thin film transistor;

a gate electrode of the second thin film transistor is coupled to the second gate line signal terminal, a source electrode of the second thin film transistor is coupled to the data line signal terminal, a drain electrode of the second thin film transistor is coupled to the second node.

13. The electroluminescent panel according to claim 9, further comprising a controller configured to apply a first high level signal in a first period to the first node via the first gate line signal terminal and apply a second high level signal in a second period to the second node via the second gate line signal terminal, wherein the first period and the second period are time-sequential.

14. The electroluminescent panel according to claim 13, wherein the first period is a first frame and the second period is a second frame.

15. A driving method for driving the pixel circuit according to claim 1, comprising:

when the first gate line signal terminal inputs a first gate line scanning signal, transmitting, by the first switch sub-circuit, a data signal provided by the data line signal terminal to the first node under the controlling of the first gate line scanning signal provided by the first gate line signal terminal;

wherein the dual-drive sub-circuit drives the luminescent sub-circuit to emit light when a voltage of the first node is a voltage level of the data signal provided by the data line signal terminal;

when the second gate line signal terminal inputs a second gate line scanning signal, transmitting, by the second switch sub-circuit, the data signal provided by the data line signal terminal to the second node, under the controlling of the gate line scanning signal provided by the second gate line signal terminal;

wherein the dual-drive sub-circuit drives the luminescent sub-circuit to emit light when a voltage of the second node is the voltage level of the data signal provided by the data line signal terminal.

16. The driving method according to claim 15, further comprising:

alternatively receiving the gate line scanning signal from the first gate line signal terminal and the second gate line signal terminal during a preset first time period.

17. The driving method according to claim 15, wherein the first switch sub-circuit and the second switch sub-circuit are configured to work alternatively.

18. The driving method according to claim 15, wherein the first driving terminal and the second driving terminal are configured to work alternatively on two flames separated by a preset time lag.

19. A display device, wherein the display device comprises the electroluminescent panel according to claim 9.

* * * * *